US008070327B1

(12) United States Patent
Gallagher

(10) Patent No.: US 8,070,327 B1
(45) Date of Patent: Dec. 6, 2011

(54) DISPLAY LAMP, IN PARTICULAR EASILY ASSEMBLED DISPLAY LAMP WITH HIDDEN LIGHT SOURCE

(76) Inventor: David R. Gallagher, Alexandria, VA (US)

( * ) Notice: Subject to any disclaimer, the term of this patent is extended or adjusted under 35 U.S.C. 154(b) by 0 days.

(21) Appl. No.: 12/970,745

(22) Filed: Dec. 16, 2010

(51) Int. Cl.
*F21V 7/09* (2006.01)
*A47F 11/10* (2006.01)

(52) U.S. Cl. ..... 362/310; 362/125; 362/300; 362/301; 362/560; 362/565; 362/806

(58) Field of Classification Search ..... 362/122, 362/125, 300–303, 310, 560, 563–565, 806; 40/406, 407, 409, 442, 540
See application file for complete search history.

(56) References Cited

U.S. PATENT DOCUMENTS 3,651,320 A * 3/1972 Lasker ..... 362/303
3,939,338 A * 2/1976 Giammalvo ..... 362/122
4,349,864 A * 9/1982 Smith ..... 362/122
4,388,678 A * 6/1983 Turner ..... 362/310
4,616,304 A * 10/1986 Von Kohorn ..... 362/101
5,105,347 A * 4/1992 Ruud et al. ..... 362/268
5,335,157 A * 8/1994 Lyons ..... 362/310
5,778,576 A * 7/1998 Kaviani ..... 40/409
6,533,446 B2 * 3/2003 Chen et al. ..... 362/559

* cited by examiner

*Primary Examiner* — Alan Cariaso
(74) *Attorney, Agent, or Firm* — Shlesinger, Arkwright & Garvey LLP

(57) ABSTRACT

Display lamp includes a base and a cover having a lower face. A side is provided between the cover and base, and the side, cover, and base define a display volume. A light source on the base directs light at a reflector on lower face of cover, and reflector reflects light from light source downwardly away in a diffuse manner within the display volume. There may be a light housing covering the light source and an oculus in an upper portion of light housing configured for directing light at the reflector. A light guide may be provided adjacent the light source for collimating light emitted from the light source into a column of light directed at the reflector. There may be a support between the cover and base for supporting an article to be displayed in the display volume, and illuminated by reflected light from the reflector.

12 Claims, 5 Drawing Sheets

FIG. 5
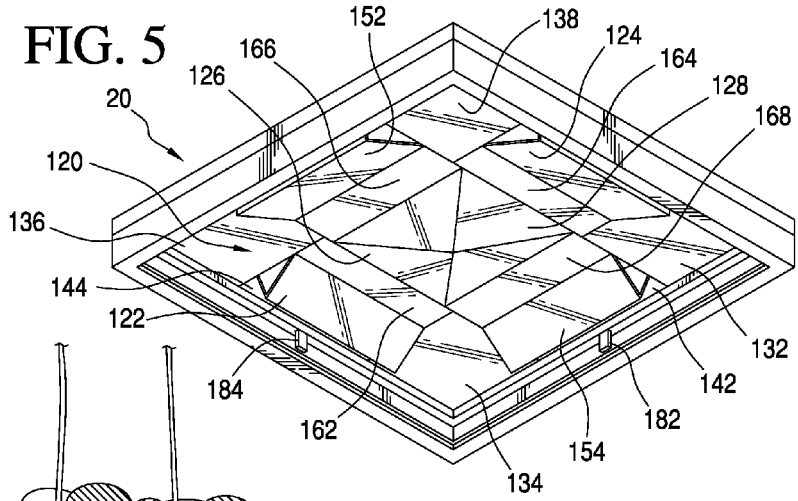
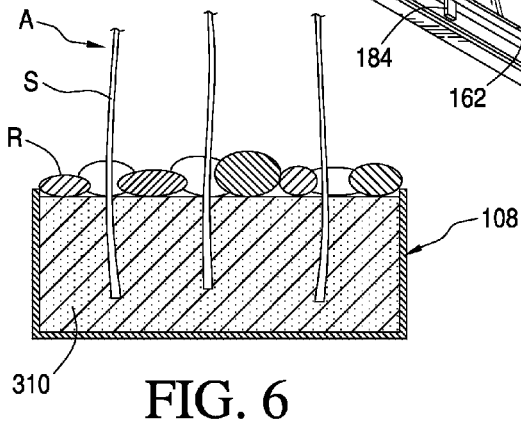
FIG. 6
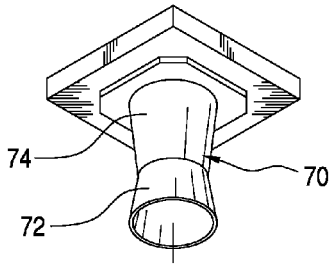
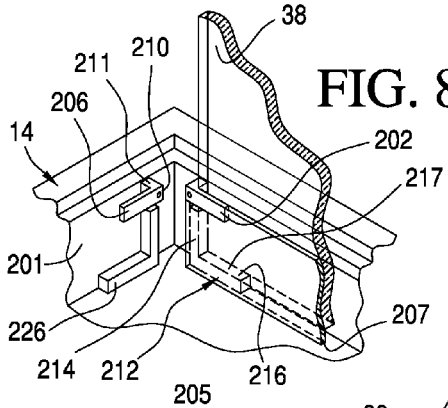
FIG. 8
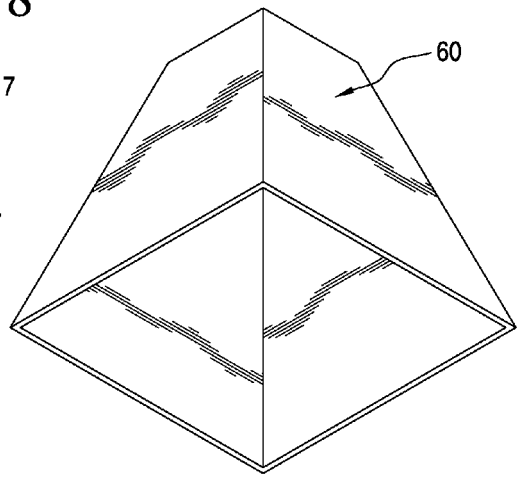
FIG. 7
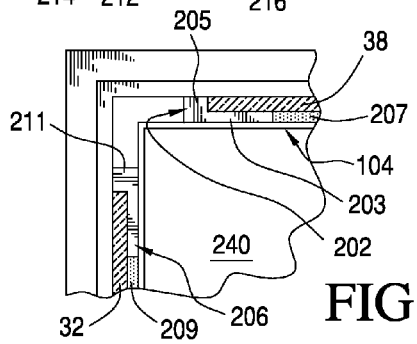
FIG. 9

DISPLAY LAMP, IN PARTICULAR EASILY ASSEMBLED DISPLAY LAMP WITH HIDDEN LIGHT SOURCE

FIELD OF THE INVENTION

The invention relates to a device for displaying objects. More particularly, the invention relates to a display lamp for displaying and lighting a variety of objects. Even more particularly, the invention relates to a display lamp which is easily constructed and assembled, and which is configured so that a user may readily change objects to be displayed, such as natural flora to be lighted and displayed, and in particular, seasonal materials.

BACKGROUND OF THE INVENTION

Display cases which are lighted are known, such as displays found in museums. Lamps are likewise known which have replaceable, decorative lampshades, such as lamp shades of different colors or patterns.

Further, lamps are known which have decorative lamp stands, including painted and carved designs and figures, such as birds, reptiles, and humans.

There exists a need for a display device in which changeable objects, to be displayed and illuminated, can be readily replaced, and which includes, for example, a hidden light source.

OBJECTS AND SUMMARY OF THE INVENTION

It is an object of the invention to overcome the drawbacks of the prior art.

It is another object of the invention to provide a display lamp which may be both readily fabricated and assembled in a factory, as well as easily assembled by the end user, such as a person who wants to display objects.

It is a further object of the invention to provide a display lamp in which displayed objects can be readily replaced, so that the user may vary the appearance of the display lamp to match the season or the user's personal preference.

It is a further object of the invention to provide a display lamp with a hidden light source.

Another object of the invention is to provide a display lamp in which the light source is a known light bulb, for example, and in which the housing is configured for collimating and directing the light source to a reflector, so that both the light source and the reflector remain substantially hidden from view in use.

These and other objects have been achieved by the display lamp according to the invention.

The display lamp includes a base, a cover spaced apart from the base, and the cover including an upper face and a lower face. There is a side provided between the cover and the base, and the side, the cover, and the base define a display volume. A light source is provided on the base. The light source is configured for directing light at the lower face of the cover, and a reflector is provided on the lower face of the cover for reflecting light from the light source downwardly away from the lower face toward the base. Further, the reflector may be configured for directing the reflected light in a diffuse, downwardly directed manner within the display volume. There may likewise be a light housing for covering the light source and an oculus in an upper portion of the light housing and configured for directing light at the reflector. A light guide may be provided adjacent the light source and configured for collimating the light emitted from the light source into a column of light directed at the reflector. There may be a support, such as a receptor, between the cover and the base for supporting an article to be displayed in the display volume, and to be illuminated by the reflected light from the reflector.

The display lamp according to the invention further includes an embodiment in which the reflector includes a plurality of inwardly and downwardly directed faces.

The display lamp according to the invention still further includes an embodiment in which each of the plurality of faces is substantially flat.

The display lamp according to the invention also includes an embodiment in which the reflector includes a flat sheet of reflective material folded into a plurality of subreflectors, each of the subreflectors including a reflective face, which may be termed a subface, configured for directing light downwardly and inwardly and within the display volume, and the reflective subfaces collectively directing light in different downward and inward directions for generating diffuse light within the display volume.

The display lamp according to the invention further includes an embodiment in which one or both of the cover and the side are removable to provide access to an article being displayed and supported by the support.

Relative terms such as up, down, upper, lower, left, and right are for convenience only and are not intended to be limiting. Likewise, examples of structures in accordance with the invention, such as a light source in the form of a light bulb, are provided as a guide to assist in understanding the invention, and are likewise not to be considered as limiting.

BRIEF DESCRIPTION OF THE DRAWINGS

FIG. 5 shows a lower perspective view of an embodiment of the reflector of the display lamp of FIG. 1 according to the invention;

FIG. 6 shows a sectional view of the tray according to the invention, in use, taken along line 6-6 of FIG. 4, with floral material displayed;

FIG. 7 shows an exploded, lower perspective view of the light housing and light guide of the display lamp of FIG. 1 according to the invention;

FIG. 8 shows an enlarged partial view of a corner structure with a side and filler in place in the base of the display lamp of FIG. 1 according to the invention, and the respective tray removed for clarity; and FIG. 9 shows a top view of the corner structure of FIG. 8 according to the invention, and with the respective tray in place.

Figure 1:
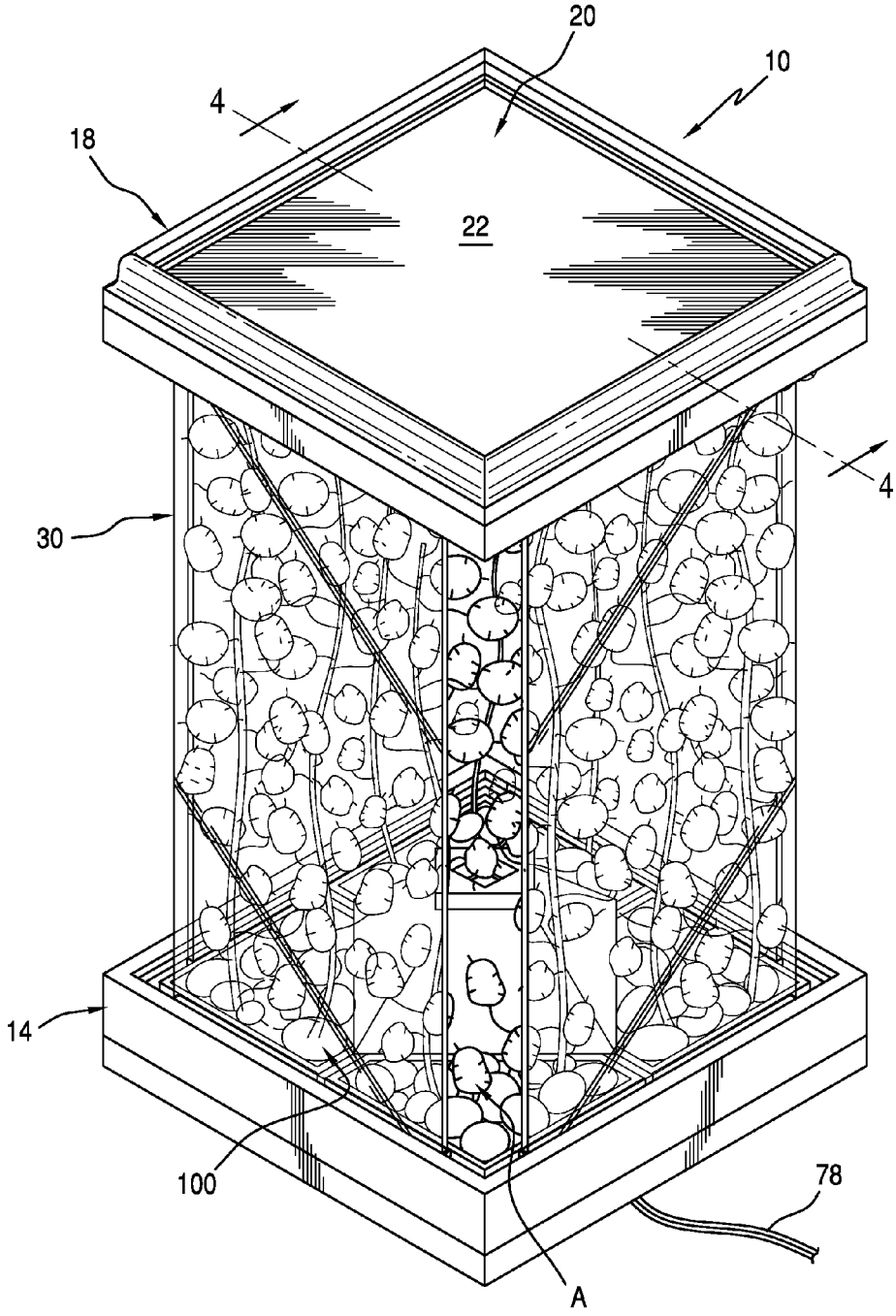
FIG. 1 shows a perspective view of an embodiment of the display lamp according to the invention, in use with floral material displayed.

These embodiments are set forth to describe and illustrate the invention, but are not intended to be limiting.

DETAILED DESCRIPTION OF THE INVENTION

The invention will be described in greater detail with reference to FIGS. 1-9 which illustrate an embodiment of a display lamp 10 according to the invention.

Display lamp 10 may include a base 14, a top 18, and a side 30. Top 18 may include a cover 20 having a top face 22 and a lower face 24 which faces inwardly of the housing toward the base 14. One or both of base 14 and cover 20 may be made of two preassembled frames nested together, and the frames may be antiqued, or otherwise pretreated.

Figure 2:
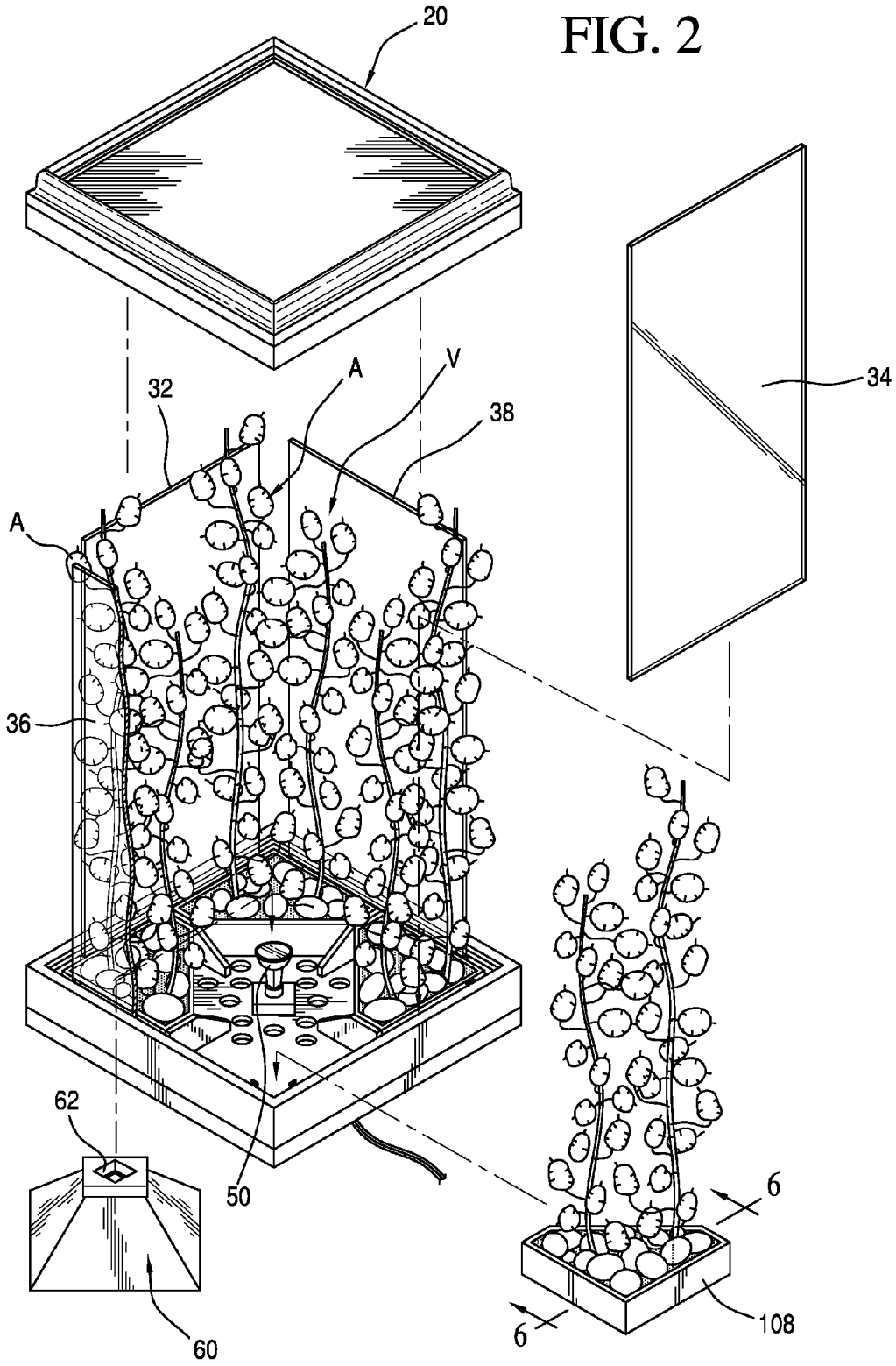
FIG. 2 shows a partially exploded perspective view of the embodiment of FIG. 1 of the display lamp according to the invention, in use with floral material displayed.
Figure 4:
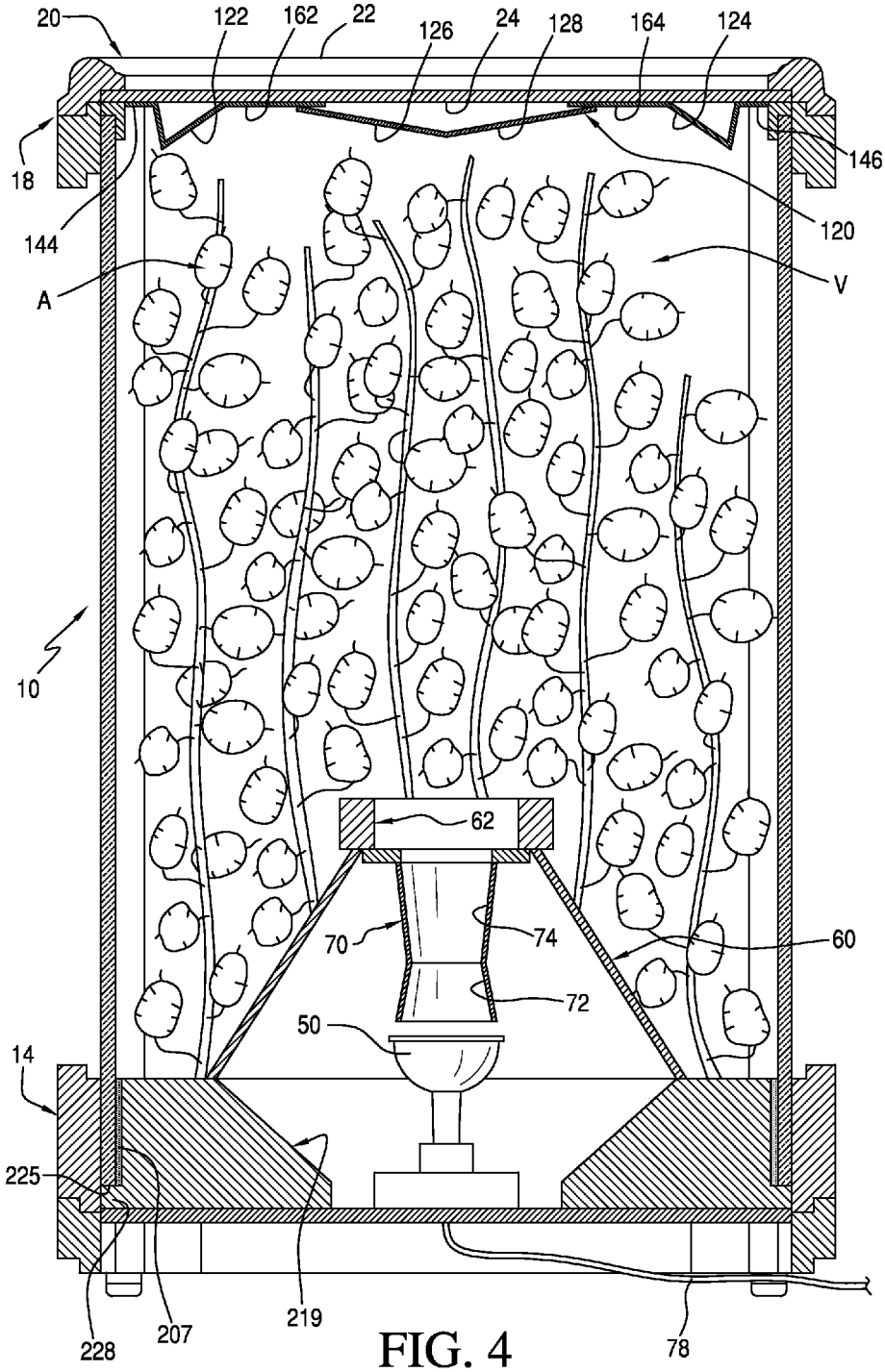
FIG. 4 shows a sectional view of the display lamp according to the invention, in use, taken along line 4-4 of FIG. 1, with floral material displayed.

Further, side 30 may include one or more individual sides, such as the illustrated left side 32, right side 34, front side 36, and back side 38. One or more of sides 32, 34, 36, and 38 may be made substantially clear, and typically clear and colorless, and typically may be made of a clear, colorless material such as glass, or plastic, depending on the intended use, as will be readily appreciated by a person having ordinary skill in the art. In that manner, the user of display lamp 10 may readily view the material being displayed, such as shown in FIGS. 1, 2, and 4.

Further, a light source 50 may be provided adjacent face 14, for example, light source 50 being configured and situated so that light emitted by light source 50 is directed upwardly toward top 18, as shown in the Figs. so that the desired lighting effect may be more readily achieved in accordance with the invention.

There may likewise be provided a light housing 60 for covering light source 50. Light housing 60 may not only cover light source 50, but also may include an oculus in an upper portion of light housing 60. The oculus is located and configured for directing light emitted by the light source upwardly toward lower face 24 of cover 20.

Light housing 60 not only serves as a shade, but likewise conceals light source 50 from view, in the case where housing 60 is prefinished to have on opaque surface. Light housing 60 may be conveniently made as a truncated pyramid which may loosely support light guide 70, or which may attach, or indeed, detachably attach light guide 70 at an upper portion thereof, as shown.

Further, a light guide 70 may be provided substantially adjacent to light source 50 for collimating light emitted by light source 50 into a column of light directed upwardly toward lower face 24 of cover 20. This may be achieved by light guide 70 including a lower portion 72, which may be a truncated cone, and a cooperating upper portion 74, which may likewise be a truncated cone. Lower portion 72 is configured for directing light from light source 50 upwardly and inwardly, and upper portion 74 is configured for directing light from lower portion 72 upwardly and inwardly, and then through oculus 62 and substantially directly upwardly toward a reflector 120 provided on lower face 24 of cover 20, as will be described in detail below. Thus, an efficient manner of directly light in an upward column of light toward reflector has been achieved with the use of a conventional light source 50, which directs light in a generally conical fashion, as will be readily understood, thanks to the provision of light guide 70 in addition to light housing 60.

An electrical cord 78 for supplying electricity to lamp 50 may be provided, and wired in a manner well known to a person having ordinary skill in the art. Electrical cord 78 may be a conventional cord for plugging into a conventional household outlet with household voltage and current, and which may include a converter, if required, as will be readily appreciated.

Still further, a support may be provided between the cover 20 and base 14, and may be provided on base 14 as shown for supporting an article A being displayed. Article A may be essentially any type of article which the user wants to display, such as the illustrated dried floral arrangement or plant material, for example, as shown by the schematically drawn Chinese money plant. The support may include one or more support elements, such as the illustrated first, second, third, and fourth trays or receptacles 102, 104, 106, and 108, respectively. As shown, trays 102, 104, 106, and 108 may be configured as substantially trapezoidal trays which may be leakproof, plastic trays, so that they may support living or dried plant material, depending on the intended use, as will be described in greater detail below.

As shown in FIG. 6, display article A, may be further supported in display lamp 10 by the provision of one or more pieces of material which is selected and configured for detachably securing article A thereto. Such support material 310 may be selected for being reusable and penetrated, if required, by a part of the display article, as will be appreciated by considering the illustrated stem S of article A in the form of a piece of floral material. Likewise, to further enhance the visual appearance and, indeed, even enhance the support of article A, camouflaging material, such as one or more rocks R, may be provided to hide support material 310, as well as the trays, such as the illustrated tray 108 of FIG. 6 from view.

Reflector 120, as described briefly above, may be best seen in FIGS. 4 and 5. Reflector 120 is oriented, located, and configured for directing reflected light from light source 50 downwardly away from lower face 24 toward base 14. Reflector 120 may include offset left and right outer subreflectors 122 and 124, as well as left and right inner subreflectors 126 and 128, for example. Each of the subreflectors is disposed and configured for directing light downwardly into the display volume V. As will be appreciated from FIG. 4, light striking left subreflector 122 will be directed inwardly and downwardly to the right as viewed in FIG. 4, and right subreflector 124 is disposed and configured for directing light which has been directed to oculus 62 likewise downwardly and inwardly, albeit in the case of subreflector 124, such light will be directed inwardly and downwardly to the left as viewed in FIG. 4. Further, light collimated by oculus 62 which strikes left inner subreflector 126 will be directed downwardly and inwardly somewhat to the left and light striking subreflector 128 will be directed somewhat downwardly and to the right.

Still further, as best seen in FIGS. 4 and 5, there may be further reflective portions of reflector 120, such as one or more of the illustrated corner reflectors 132, 134, 136, and 138, each of which may be angled away from the corner of cover 20 for likewise downwardly and inwardly directing reflected light into display volume V. In order to readily attach reflector 120 to lower face 24, one or more reflective attachment legs 142, 144, and 146 may be provided. A fourth, unnumbered attachment leg may be provided adjacent a subreflector 152, the unnumbered attachment leg which is a counterpart, so to speak, to attachment leg 142 on the opposite side of reflector 120 is not visible in FIG. 5. Likewise, an angled subreflector 154 may be provided spaced apart from subreflector 152, as seen in FIG. 5. Even further, additional flat or substantially flat subreflectors 162 and 164, 166, and 168 may likewise be provided, as shown.

Collectively, each of these subreflectors and their respective faces, as well as the other illustrated and numbered subreflectors, collectively direct light downwardly in a desired, diffuse manner for evenly illuminating display article A.

In order to protect and enclose article A inside display volume V, a number of retaining clips, such as the clips 182 and 184 on covers 20, may be provided. Two additional clips, not visible in FIG. 5, may be provided on the other two sides of the four-sided cover in order to retain respective ones of sides 32, 34, 36, 38 at the top of display lamp 10.

Figure 3:
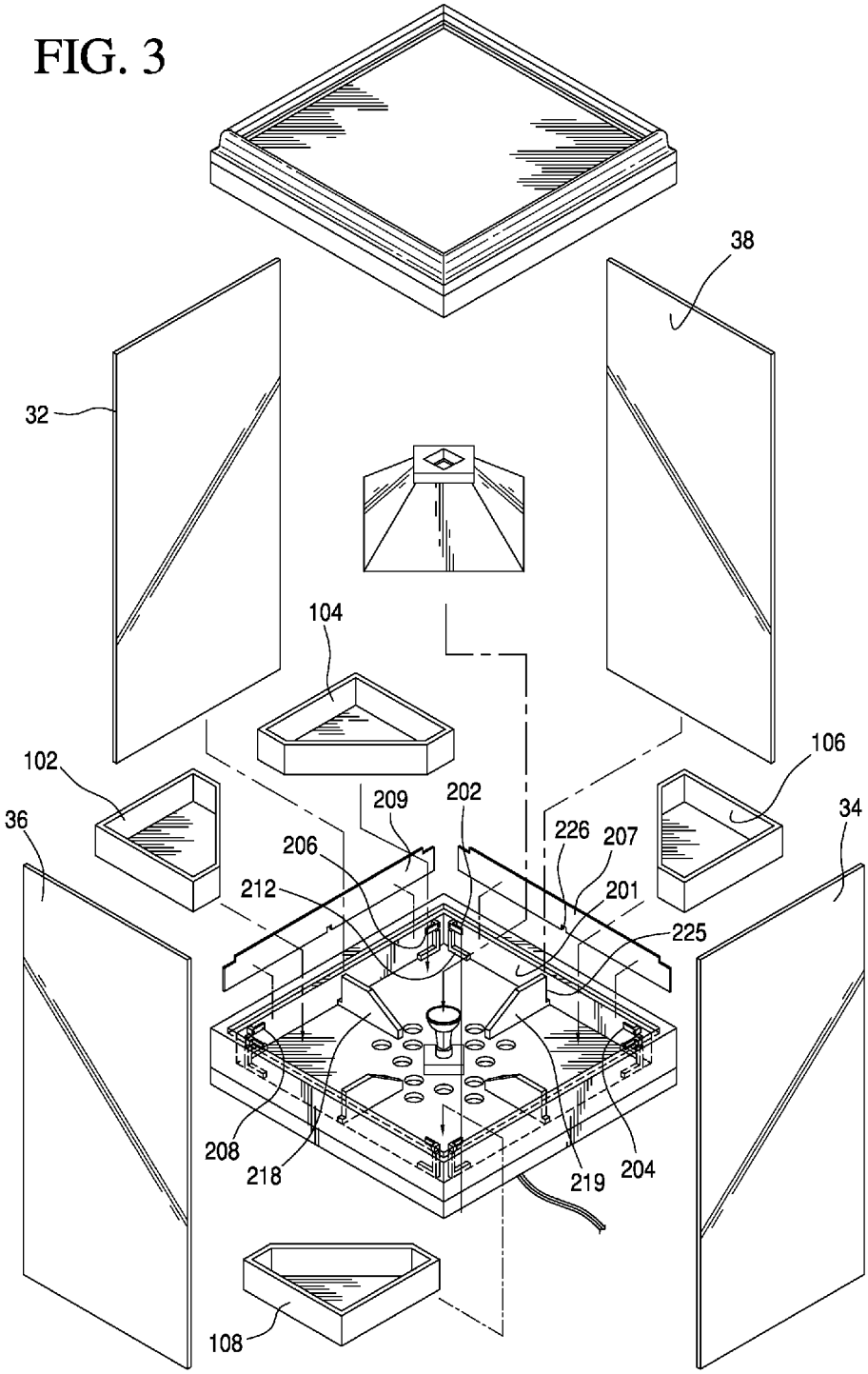
FIG. 3 shows a further exploded perspective view of the display lamp embodiment of FIG. 1 according to the invention, with floral material removed for clarity.

There will likewise be lower retaining clips and other retaining structure on the base 14, as will be described in connection with FIGS. 3, 8, and 9.

There may be provided lower pairs of retaining clips, such as paired retaining clips 202 and 204 provided on an inner face 201 of base 14. The pair of clips, 202, 204 are sized and directed with their respective openings toward each other for receiving side 38 therein, as shown in detail in FIGS. 8 and 9.

A fastener 210 and/or an adhesive, for example, may be used to secure clips 206 and 202 to the inner face of base 14. It will be appreciated that fastener 210 may extend through leg 211 of clip 206 and through inner face 201 into base 14 for securing clip thereto.

Additional pairs of lower clips, such as the illustrated clips 206 and 208 for securing side 32 may likewise be provided, as well as the additional respective unnumbered clips for securing the other two sides 34 and 36. As shown and labeled in FIG. 9, lower clip 202 may include a leg 203 extending sideways, or substantially horizontally, for receiving side 38 securely therein. The leg 203 has a width or thickness which is substantially the same as the width or thickness of a liner or spacer 207. In that manner, liner 207 substantially fills the void between side 38 and tray 104, as shown in FIG. 9. Thanks to the provision of further liners, such as a liner 209 for filling the void between side 32 and clip 206, as well as two other respective unnumbered liners, each of trays 102, 104, 106, and 108 will be securely held within the base thanks to the liners 207 and 209, as well as dividers 218 and 219, which may be substantially trapezoidal, as shown, or any other desirable shape. Respective dividers, such as divider 218 and 219 may be provided with a notch, such as notch 225 of 219. Notch 225 may be sized for receiving both side 38 and liner 207.

Further, a cutout portion 226 may be provided in liner 207 so as to receive the unnotched or solid portion 228 of divider 219 so that liner 207 may sit substantially flush with top face 240 of base 14.

In addition, in order for liner 207 to be securely held in place, liner 207 may include a reduced portion 213 which fits between clip 202 and top face 240 of base 14. More specifically, reduced portion 213 will fit below sideways extending leg 203 of fastener 202 and on top of top face 240 of base 14. In a like manner, liner 207 may include a counterpart reduced portion 215 on the right side thereof (as viewed in FIG. 3) which fits between clip 204 and top face 240 of base 14.

It is contemplated that the reduced portions 213,215 may be provided with notches, or other connecting elements, so that adjacent reduced portions of adjacent liners, such as liners 207 and 209, may be secured at the corner of base 14, such as at the corner adjacent to clips 202 and 206, to further assist in retaining the liners 207, 209 in place, as will be readily appreciated.

Additional support of side 38, for example, may be provided by the illustrated support 212. Additional supports, such as support 214 for side 32, as well as further such supports as shown in FIG. 3 may likewise be provided. Support 212 may include an upwardly extending leg 214, as well as a laterally extending leg 216. Side 38 will be supported by an upper face 217 of leg 216, and side 38 will abut upper leg 214, which upper leg 214 is provided below the short leg 205 of clip 202.

Support 212 is thus inwardly of the extent of the width of leg 203 of clip 202, as viewed from above. In this manner, a gap would be present between clip 202 and tray 104, as shown in FIG. 9, if it were not for the use of liner 207 filling that gap, as shown in FIG. 9, so that tray 104 is securely received in position, as described above.

In use, the user, such as the purchaser, may buy each of the parts on his or her own. It is likewise contemplated that the user may buy a kit, in which many of the components described herein have been provided separately, and the user can assemble the kit in order to make his own lighted display lamp.

Good results have been achieved, when base 14 and cover 20 have been made of wood, such as plywood, and have been provided with four clips, such as upper clips, 182, 184 provided by the fabricator, or installed by the user.

In an analogous fashion, the eight lower clips, such as clips 202, 204, 206, and 208, may be provided pre-attached in such a kit, or the user may attach them, as shown, by use of fastener 210.

The four dividers on base 14, such as numbered dividers 218 and 219, may likewise be preinstalled by the fabricator at the desired width to accommodate respective trays 102, 104, 106, and 108, when assembled with the other components as described above.

Protective glides may be provided on a lower face of base 14 to protect an object, such as a piece of furniture, on which the inventive display lamp 10 is placed. For example, the protective glides may be received by corner blocking pieces at the respective corners, as shown.

Cover 20 may likewise be made of two preassembled frames, which may be antiqued, as with base 14. Upper clips, such as numbered clips 182, 184 may be preinstalled by the fabricator, or added by the end user. It is contemplated that a material, such as a perimeter mounted weather-stripping material may be provided adjacent upper clips 182, 184 for seating the top against respective supporting sides, such as side 38.

Sides 32, 34, 36, and 38 may each be made of clear, colorless glass, which may be conventional glass with pre-smoothed or beveled edges for ease of use by the end user.

As shown, and as may be appreciated from FIGS. 1, 2, and 4 in particular, it is contemplated that sides, such as adjacent sides 32 and 36 need not be directly adjacent each other along their edges. In that manner, a more open feel is provided for the display of article A; this also limits air circulation into the display volume to reduce dust, and even provides for limited projection of an article, such as the illustrated floral material to indeed project beyond the enclose display volume, as may be appreciated from consideration of the upper edges of FIG. 2. Still further, thanks to sides 32 and 36, for example, not being in contact with each other, the need for a corner post to secure panels 32 and 36 at the corners is eliminated.

Thanks to the provision of smooth edges, and the sizing and weight of the sides 32, 34, 36, 38, removal and insertion of the sides is facilitated and enhanced thanks to the elegantly simple engagement with the sized, mating lower clips, such as illustrated clips 202, 204 receiving side 38.

It is further contemplated that light source 50 may be a form of a single MR-16 low voltage light bulb directed vertically through the center of light housing 60, as shown, and described.

Thanks to the removability of each of the four (4) trays 102, 104, 106, and 108, the user may easily remove one or more of the trays for facilitating the arrangement of the article being displayed in display map 10.

It is further contemplated that to enhance and facilitate assembly by all ages and skill levels of users, most if not all of the parts of the inventive display lamp which might prove difficult for a user to assemble, may be preassembled by the fabricator.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A display lamp, comprising:

a) a base;

b) a cover, the cover being spaced apart from the base, and the cover including an upper face and a lower face;

c) a side being provided between the cover and the base, and the side, the cover, and the base defining a display volume;

d) a light source provided on the base, and the light source being configured for emitting light toward the lower face of the cover;

e) a reflector being provided on the lower face of the cover, the reflector being configured for reflecting light from the light source downwardly away from the lower face toward the base, and the reflector being configured for directing the reflected light in a diffuse, downwardly directed manner and within the display volume;

f) a light housing being provided for covering the light source and an oculus provided in an upper portion of the light housing and configured for directing light at the reflector;

g) a light guide provided adjacent the light source, the light guide being configured for collimating the light emitted from the light source into a column of light, the light column being directed at the reflector; and h) a support being provided adjacent the base for supporting an article to be displayed in the display volume, and to be illuminated by the reflected light from the reflector.

2. Display lamp as in claim 1, wherein:

a) the reflector includes a plurality of inwardly and downwardly directed faces.

3. Display lamp as in claim 2, wherein:

a) each of the plurality of faces is substantially flat.

4. Display lamp as in claim 1, wherein:

a) the reflector includes a flat sheet of reflective material, the flat sheet being folded into a plurality of subreflectors, each of the subreflectors including a reflective subface configured for directing light downwardly and inwardly and within the display volume, the reflective subfaces collectively directing light in different downward and inward directions for generating diffuse light within the display volume.

5. Display lamp as in claim 1, wherein:

a) the cover being removable to provide access to an article being displayed and supported by the support.

6. Display lamp as in claim 5, wherein:

a) the side being removable to provide access to an article being displayed and supported by the support.

7. Display lamp as in claim 4, wherein:

a) the light guide includes at least one truncated cone, and the at least one truncated cone includes a sheet of reflective material.

8. Display lamp as in claim 7, wherein:

a) the at least one truncated cone includes two truncated cones, and the two truncated cones each includes a sheet of reflective material.

9. Display lamp as in claim 1, wherein:

a) the light guide includes at least one truncated cone, and the at least one truncated cone includes a sheet of reflective material.

10. Display lamp as in claim 9, wherein:

a) the at least one truncated cone includes two truncated cones, and the two truncated cones each includes a sheet of reflective material.

11. Display lamp as in claim 1, wherein:

a) the light source includes one of an MR-16 incandescent light bulb and an LED light bulb.

12. Display lamp as in claim 1, wherein:

a) the support is a tray; and b) the tray is supported by and received on the base.

* * * * *